US007261251B2

(12) United States Patent
Kühn et al.

(10) Patent No.: US 7,261,251 B2
(45) Date of Patent: Aug. 28, 2007

(54) YARN FEEDING DEVICE

(75) Inventors: Falk Kühn, Rottenburg-Kiebingen (DE); Hermann Schmodde, Horb-Dettlingen (DE)

(73) Assignee: Memminger-IRO, Dornstetten (DE)

( * ) Notice: Subject to any disclaimer, the term of this patent is extended or adjusted under 35 U.S.C. 154(b) by 10 days.

(21) Appl. No.: 10/513,454

(22) PCT Filed: Apr. 25, 2003

(86) PCT No.: PCT/DE03/01345

§ 371 (c)(1),
(2), (4) Date: Nov. 1, 2004

(87) PCT Pub. No.: WO03/093549

PCT Pub. Date: Nov. 13, 2003

(65) Prior Publication Data

US 2005/0126228 A1 Jun. 16, 2005

(30) Foreign Application Priority Data

May 2, 2002 (DE) ..... 102 19 537

(51) Int. Cl.
*B65H 51/30* (2006.01)

(52) U.S. Cl. ..... 242/366

(58) Field of Classification Search ..... 242/365.6, 242/366; 66/132 R, 132 T
See application file for complete search history.

(56) References Cited

U.S. PATENT DOCUMENTS 2,189,492 A * 2/1940 Henne ..... 66/132 R
2,539,527 A 1/1951 St. Pierre
2,641,913 A * 6/1953 Alric ..... 66/132 R
3,922,887 A * 12/1975 Mishcon ..... 66/132 T
4,489,899 A * 12/1984 Calamani et al. ..... 242/365.6
4,598,560 A * 7/1986 Sawazaki ..... 66/132 T
5,782,424 A * 7/1998 Horvath et al. ..... 242/419.3
6,270,032 B1 * 8/2001 Chen ..... 242/365.6

FOREIGN PATENT DOCUMENTS

DE 2635200 A 2/1977
GB 1509309 5/1978
GB 1509309 A * 5/1978
GB 2138846 A 10/1984
GB 2169927 A * 7/1986
SU 785168 A 12/1980

OTHER PUBLICATIONS

International Search Report (Sep. 11, 2003).

* cited by examiner

*Primary Examiner*—Patrick Mackey
*Assistant Examiner*—William E. Dondero
(74) *Attorney, Agent, or Firm*—Leydig, Voit & Mayer, Ltd.

(57) ABSTRACT

A yarn lifting element (28), which is provided on a positive thread regulating wheel, comprises straight yarn-bearing surfaces (34,35) whose position cannot be displaced by the yarn (2), enabling the yarn to slip in relation to the thread feeding wheel (17) when required. Said additional measure enables the positive thread regulating wheel to be used in areas which were previously excluded on account of the required synchronicity between the feeding of the thread and the consumption of the thread.

20 Claims, 10 Drawing Sheets

YARN FEEDING DEVICE

FIELD OF THE INVENTION

The invention relates to a yarn delivery device for delivering a yarn to a yarn consumer location, such as a knitting station of a knitting machine.

BACKGROUND OF THE INVENTION

Yarn delivery devices are used to draw off the yarn from a yarn supply, for example a bobbin, and to deliver it to a yarn-consuming arrangement, for example at a preset yarn speed, or at a preset yarn tension, or with other preconditions. Such yarn-consuming arrangements can be knitting stations of knitting machines, or other mechanical arrangements. Elastic yarns, inelastic yarns made of natural fibers or synthetic fibers, staple fiber yarns, other yarns or monofilaments are considered to be yarns. Often the yarn consumption location does not consume yarn at a constant rate. For example, such is the case when the yarn consumption location is switched on or off, for example in connection with loop or Jacquard machines. Friction feed wheel units are known for this, wherein the yarn is looped around a rotating drum, but is lifted off the drum at one or several locations. For example, U.S. Pat. No. 2,539,527 discloses a yarn delivery device whose yarn delivery wheel consists of a drum-shaped rod cage. Two hook-shaped spiral springs are arranged in the vicinity of the rod cage, which partially lift the single yarn winding looped around the drum off the rod cage. The looping characteristics of the rod cage change with different yarn tensions because of the deflection of the spiral springs.

Another yarn delivery device is known from French Patent 964 455. That yarn delivery device has a rotating yarn delivery drum. A yarn is looped several times around the drum. The individual yarn loops created in this way also loop around two pivotably seated pins, which extend next to the yarn delivery drum either parallel or at an acute angle relative to the drum, depending on the pivot position. This allows the pins to be pivoted away from the drum in order to increase the yarn reserve when the downstream located knitting station does not take on yarn. With this device, the looping characteristics also change because of the movement of the pins.

A yarn delivery device is also known from USSR Patent 785168. This device has a rotating cylindrical yarn delivery drum and a yarn lifting element assigned to the drum. The yarn lifting element has a kinked yarn contact surface, with a first section that extends at an acute angle of 15° to 20° relative to the drum surface and a second section that extends parallel to the drum surface. The lower end of the yarn lifting element is forked, with a machine shut-off lever entering into the space between the tines of the fork. Because of the kink between the upper part and lower part of the contact surface, the individual windings looped around the lifting element and the drum have different lengths. Therefore, a strong or a weak yarn pull therefore is not easily propagated evenly through all windings.

There is often the desire to operate a yarn delivery device in different modes of operation. However, the above-mentioned prior art devices are arranged either as positive feed wheel units with a yarn supply, or as friction feed wheel units. It has also been noticed that the commercially available devices must be adapted to the yarn to be delivered. This is a considerable limitation, and the removal thereof is of primary importance.

OBJECTS AND BRIEF SUMMARY OF THE INVENTION

In view of the foregoing, it is an object of the invention to create a yarn delivery device which can be employed in as many ways as possible.

The yarn delivery device of the invention has at least one yarn contact surface in the vicinity of the yarn delivery wheel, over which the windings looping around the yarn delivery wheel can run. For example, a single yarn lifting element is provided for this. Alternatively, two yarn contact surfaces can be provided on two separate yarn lifting elements. However, the basic geometric design of the yarn contact surface(s) of the yarn lifting element and the design of the yarn delivery wheel is common to both yarn delivery devices. The yarn delivery device in accordance with the invention can be employed as a positive feed wheel unit, as well as a friction feed wheel unit.

The yarn delivery wheel has a yarn inlet area with a means which provides the wound yarn lap with a forward feed. For example, this is achieved by configuring the yarn inlet area as a very steep cone, which makes a continuous transition into the storage area, which in turn can be embodied as a cone with a slight taper. The yarn windings picked up by the rotating yarn delivery wheel are forced between the inlet area and the storage area and therefore displace the wound lap in the axial direction in order to provide space for the yarn windings. This is particularly important for the positive operation in which the yarn does not run over the yarn lifting element. For performing a friction operation, the yarn lifting element permits a limited fictional connection between the yarn and the yarn delivery wheel, so that the yarn delivery device can supply yarn amounts that fluctuate over time with a more or less constant number of revolutions of the yarn delivery wheel. The forward feed of the wound yarn lap on the yarn delivery wheel can be aided by the cone shape of the storage area. An acute angle between the yarn contact surface of the yarn lifting element and the side of the yarn delivery wheel remote from the yarn lifting element can also provide a forward feed of the lap.

The forward feeding mechanism provided in the inlet area which, as mentioned above, preferably is accomplished by the shaping of the yarn delivery wheel itself, can also be provided by other devices moving the wound yarn lap in the axial direction. For example, the forward feeding mechanism can be a disk arranged in the yarn delivery wheel, which has spokes extending outward through openings in the yarn delivery wheel. If the axis of rotation of the disk is slightly inclined relative to the axis of rotation of the yarn delivery wheel, the spokes of the disk push the wound lap axially forward on one side of the yarn delivery wheel. Moreover, the storage area can consist of two cages running inside each other at an acute angle and causing a forward feed of the yarn.

Independent of the actual embodiment of the forward feed mechanism, the yarn delivery device can be used with or without the yarn lifting element. If the yarn lifting element is not used, or even removed, the forward feed mechanism causes the formation of an ordered wound lap. The wound lap can have ten to twenty windings, without the windings being placed on top of each other. However, with friction operation at least several windings of the wound yarn lap are conducted over the yarn lifting element and its yarn contact surface. The required forward feed of the lap is provided here partially by the interaction between the yarn lifting element and the yarn delivery wheel. In this case, the axial forward feed force acts on each individual winding, so that a relatively large wound lap with ten to twenty windings (for example fifteen windings) can be placed on the yarn delivery wheel. A friction operation is made possible even with large wound laps of this type, and the placement of individual windings on top of each other (which would interfere with the operation) is prevented. The large wound yarn lap, one or all windings of which are conducted over the yarn lifting element, ensures that the end of a yarn does not run into the goods to be produced if a yarn is broken.

A run-in interrupter, which detects a yarn break, shuts off the downstream connected machine using the yarn. The yarn reserve on the yarn delivery wheel is sufficient to supply the machine with yarn as it runs down. This applies to the positive operation, as well as to the friction operation. Thus, it is possible to connect a new yarn to the existing yarn end, so that operational interruptions can be swiftly and simply fixed.

In a preferred configured of the invention, the yarn delivery wheel is embodied in such a way, and the yarn lifting element is arranged in such a way, that each relatively older winding in the wound lap being formed is slightly shorter than the adjoining newer winding. In this way, each individual winding is subjected to the forward feed effect. Depending on the type of yarn and yarn thickness, the reduction of the winding length can be matched by changing the inclined position of the yarn lifting element. In this way it is possible to regulate spacings possibly occurring between the windings.

The yarn contact surface is preferably designed to be straight, i.e. free of bends or kinks. The yarn cannot change the position of the yarn lifting element. This results in constant feed conditions. Moreover, the yarn lifting element(s) is/are preferably arranged in such a way that less than 240° of each yarn winding of the wound yarn lap is in contact with the yarn delivery wheel (contact angle), i.e. a section greater than 120° of each winding is lifted off the yarn delivery wheel. The entire wound lap rests against the yarn delivery wheel with less than ⅔ of the length of a (cylindrical) wound lap resting completely against the yarn delivery wheel. However, preferably the contact angle is greater than 180°.

It has been found that the straight contact surface (i.e. configured without kinks) of the yarn lifting element represents a good compromise for all yarns to be conveyed and delivered, in particular in connection with a yarn delivery wheel such as is used with purely positive feed wheel units. A drop in the yarn output tension can occur temporarily that progresses through all of the windings because of the kink free embodiment of the contact surfaces and results in slippage. During this, in case of low yarn tension (loose windings) yarn windings getting on top of each other is prevented.

It also has been shown that it is possible to process a particularly large spectrum of possible yarns if the distance between the two contact surfaces is approximately 10 mm to 30 mm, in particular 12 mm to 18 mm. This specifically applies in connection with yarn delivery wheels embodied as rod cages or corrugated drums. In this case the distance of the drum advantageously is in the range between 10 mm and 20 mm. The yarn lifting elements can be made of a ceramic material (wear resistance) or wire pins or wire loops (easy to produce). Moreover, the yarn lifting element can be consist of a bent sheet metal part. If the yarn lifting element is made of metal (wire or sheet metal), it is advantageous to provide a wear-reducing coating, for example of a ceramic material.

Except for the yarn delivery wheel, the yarn delivery device preferably does not have any other yarn conveying mechanisms, such as strips or the like resting against the yarn delivery wheel. Thus, the yarn delivery wheel has an unencumbered outer circumference. This permits controlled slippage between the yarn delivery wheel and the yarn.

The yarn delivery wheel has a yarn inlet section, which can be tapered. In this sense, tapered means that the diameter of the yarn delivery wheel changes in the area of the yarn inlet section as a function of the axial direction. In this case, the taper can have the shape of a steep circular taper or other curved shapes. The tapering shape enables the generation of a forward feed motion on the yarn delivery wheel by the running up yarn. In this case, the yarn inlet section is preferably configured as a closed surface area or as a rod cage.

In an advantageous embodiment, the yarn delivery wheel can be provided with a tapering yarn run-off edge. The yarn run-off edge can also be configured as a truncated cone or other tapering shape. The yarn run-off edge allows an oblique yarn draw-off, which is particularly advantageous with yarns causing deposits that contain dressings or sizing, or are very fuzzy.

A storage area is provided between the inlet section and the yarn run-off edge. The storage area preferably does not have a cylindrical configuration and has a diameter that is less than the diameter of the inlet section and the yarn run-off edge. In this case, the storage area can have a polygonal configuration, so that the yarn windings are only picked up by strip-shaped areas of the yarn delivery wheel. The yarn delivery wheel can be configured as a rod cage, or as a one-piece element, for example as a deep-drawn sheet metal element or as a ceramic element. The contact of the yarn windings in polygonal sections enable the positive delivery without slippage in a particularly effective manner, as well as the slippage-containing conveyance of the yarn. The exterior diameter of the storage area can slightly decrease in the direction of the yarn run-off edge.

The inlet yarn guidance arrangement of the yarn delivery device is preferably arranged above the storage area, so that the yarn is forced to run into the storage area over the inlet area of the yarn delivery wheel. In this case, the inlet yarn guidance arrangement is preferably rigidly seated, which provides defined yarn inlet conditions.

In an advantageous embodiment, the outlet yarn guidance arrangement is also rigidly seated and preferably arranged below the storage area. In this case, the outlet yarn guidance arrangement is preferably clearly offset in the axial and radial directions relative to the yarn delivery wheel, so that it is also located below the yarn run-off edge. By means of this, the outgoing yarn can slip over the run-off edge thereby keeping it clean. The rigid, possibly manually adjustable seating of the outlet yarn guidance arrangement provides defined yarn outlet conditions.

Preferably both yarn guidance arrangements are arranged on same level as the axis of rotation of the yarn delivery wheel. This provides symmetrical operating conditions, whereby the yarn delivery wheel can be driven counter-clockwise or clockwise.

The yarn lifting element can be fixed on the yarn delivery device. However, the yarn lifting element preferably can be manually adjusted. An adjusting device can be provided for setting the inclination of the yarn lifting element relative to the longitudinal axis, or axis of rotation, of the yarn delivery wheel. In the course of this, fine adjustments can be performed for adapting the yarn delivery device to various yarn properties or applications.

The yarn lifting element additionally can be seated so it can be displaced on a circle, which is concentric relative to the yarn delivery wheel. This potential displacement provides improved handling capabilities without substantially affecting the yarn conveying properties. It can be helpful, particularly where space is limited (for example, if a number of identical yarn delivery devices are mounted on a machine circle of a circular knitting machine) to pivot a support carrying the lifting element laterally to the side of the yarn delivery device for manually placing the yarn on it. Once the yarn has been placed on it, the support can remain in this position, or the support can be pivoted by 90°, for example, so that the lifting element is located underneath the main body or main support of the yarn delivery device and therefore does not require more space. The position is mainly unimportant for the function of the yarn delivery device. This arrangement not only eases operation, but also helps prevent wrong settings.

The lifting element preferably extends above the storage area in the inlet area, as well as at the run-off edge, of the yarn delivery wheel. This ensures that the straight yarn contact surfaces extend over the entire storage area of the yarn delivery wheel.

The yarn lifting element is preferably releasably connected to the yarn delivery device. Because of this arrangement, the yarn delivery device can be operated purely as a positive feed wheel unit, if necessary. The yarn lifting element can be offered as an accessory or ancillary part.

With a yarn delivery device having two lifting elements, it can be advantageous to seat both lifting elements on different supports, which can be adjusted relative to each other. This has the useful advantage particularly in those cases where the lifting elements are set to different radii relative to the axis of rotation of the yarn delivery wheel. There is the option of placing both lifting elements one behind the other in the radial direction, so that only the one on the outside is operational.

A pulley can be used as the drive mechanism for the yarn delivery wheel. It is also possible to provide the yarn delivery device with an individual electric drive motor, which drives the yarn delivery wheel. For example, the drive motor can be operated corresponding to the yarn demand or controlled by the yarn tension.

DETAILED DESCRIPTION OF THE INVENTION

Figure 1:
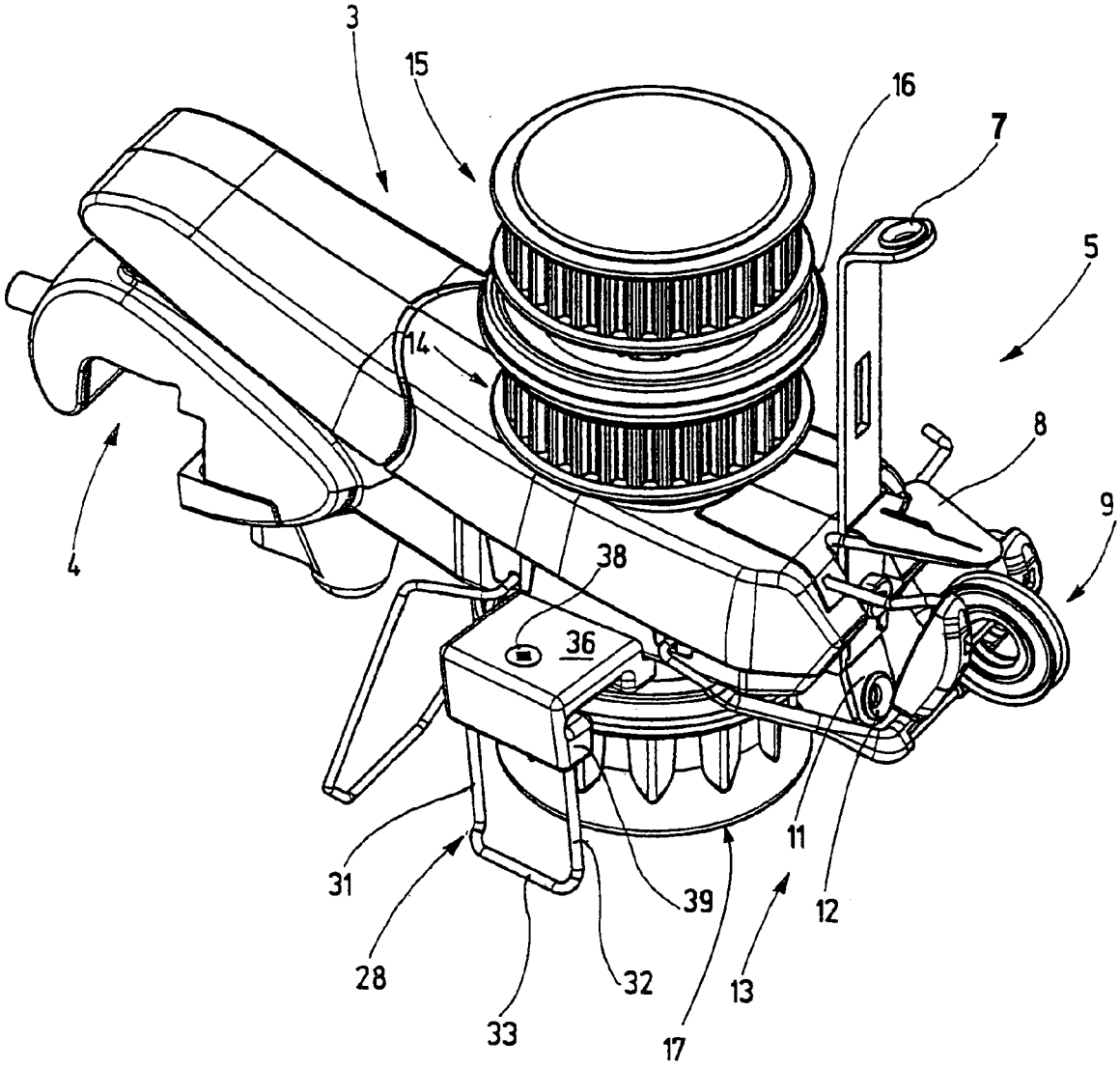
FIG. 1, a perspective representation of the yarn delivery device.

An exemplary yarn delivery device 1 according to the invention is illustrated in FIG. 1 The yarn delivery device is used for delivering a yarn 2 (shown in FIG. 2) to a knitting station of a knitting machine (not shown) or other yarn consumption station. The yarn delivery device 1 has an elongated base body 3, for example made of a plastic material, which is equipped at one end with a clamp 4 for fastening the yarn delivery device 1 on a ring-shaped support (machine ring) of a knitting machine. On its opposite end, the base body 3 is provided with a yarn inlet arrangement 5 that includes an inlet eye 7 (made for example of a ceramic material), a knot catcher 8, a yarn brake 9 and an inlet eye 12 that is immovably maintained on a rigid support 11, which constitutes a yarn inlet guidance arrangement 13.

A shaft is provided that supports one or more pulleys 14, 15 on its upper end. The pulleys can be coupled, selectively fixed against relative rotation, with the shaft by means of an axially displaceable coupling ring 16. The shaft is rotatably seated on or in the base body 3 between the yarn inlet guidance arrangement 13 and the clamp 4. Below the base body 3, the shaft is connected, fixed against relative rotation, to a yarn delivery wheel 17, which therefore can be rotatingly driven by the pulleys 14, 15. The yarn delivery wheel 17 has an inlet area 18, which is distinguished in that its diameter relative to the axial direction $A_x$ of the yarn delivery wheel 17 becomes smaller as it extends from the top toward the bottom. As can be seen, the inlet area 18 consists of a first tapering section with a small opening angle that makes a curved transition into a second tapering section 18*b* with a very large opening angle. The tapering section comprises a guide surface 18*a* as a forward feed mechanism for the lap 26. The shaft is substantially oriented. During slippage-free operation (positive operation), a yarn that has not been removed can rotate, sagging toward the bottom, in the manner of a crank, without being wound up backward.

A storage area 21, whose horizontal cross section preferably deviates from a circular shape, adjoins the inlet area 18, which is configured as a closed surface without interruptions. In the illustrated embodiment, the yarn delivery wheel 17 is formed as a one-piece deep-drawn sheet metal element. In this instance, the storage area 21 comprises a cylindrical section 22, from which ribs 23 protrude. Each of the ribs has a rounded back, against which the yarn 2 rests with individual windings 24, 25, as a lap 26. The windings 24, 25 lie freely between the individual ribs 23. Yet looked at as a whole, the yarn delivery wheel 17 is free of openings. The storage area 21 is also closed. The storage area 21 can be slightly tapered toward the bottom.

Starting at the cylindrical section 22, the diameter of the yarn delivery wheel increases again until it exceeds the outer diameter of the ribs 23. A yarn run-off edge 27 starts there and widens in a conical manner. In this case, the yarn run-off edge forms a smooth, closed surface, into which the ribs 23 transition without any shoulders.

The yarn delivery wheel 17 rotates freely, i.e. it is only in contact with the yarn 2. No further elements that would touch the yarn delivery wheel 17 or convey the yarn 2 exist.

Figure 2:
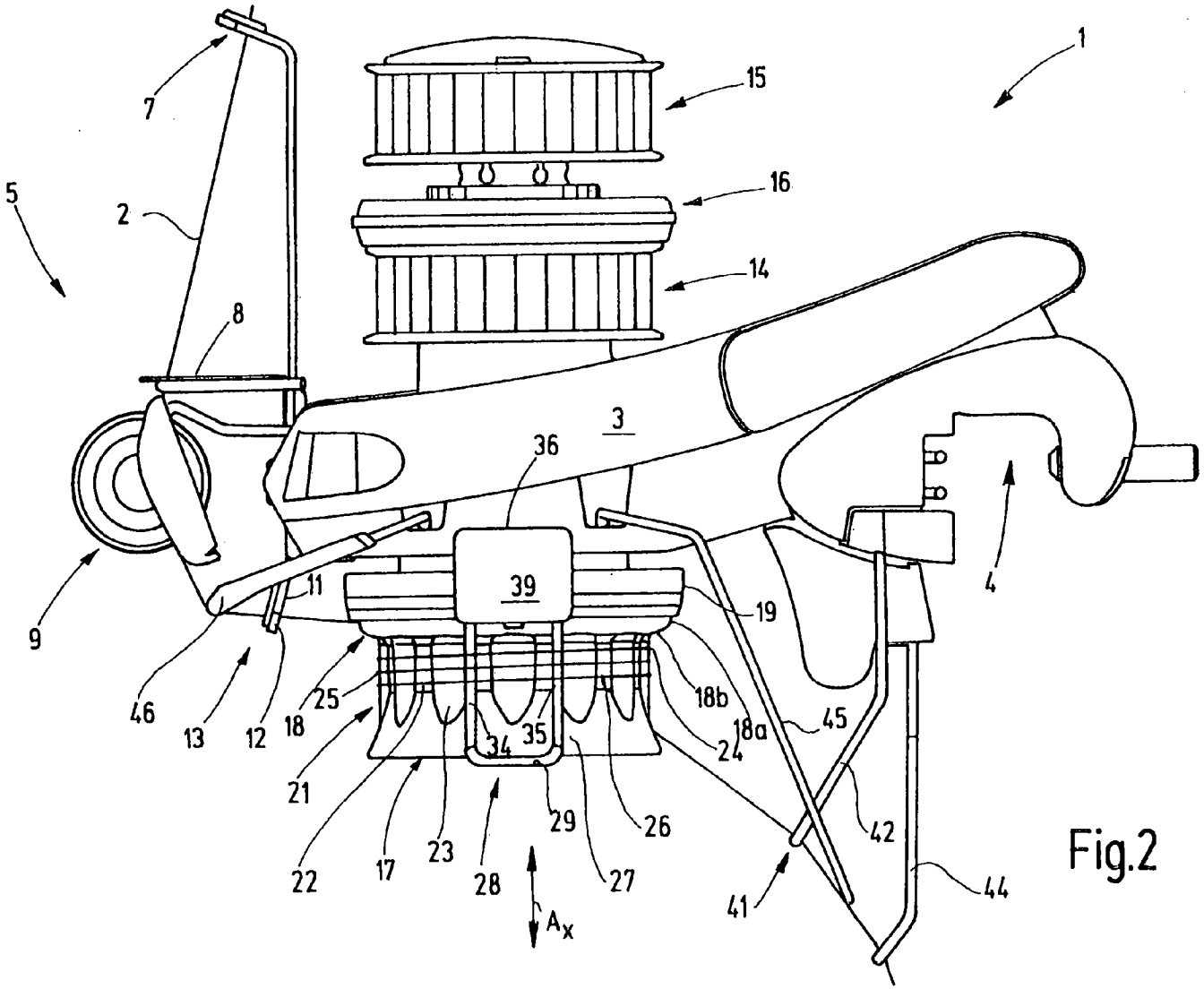
FIG. 2, a lateral view of the yarn delivery device in FIG. 1.
Figure 3:
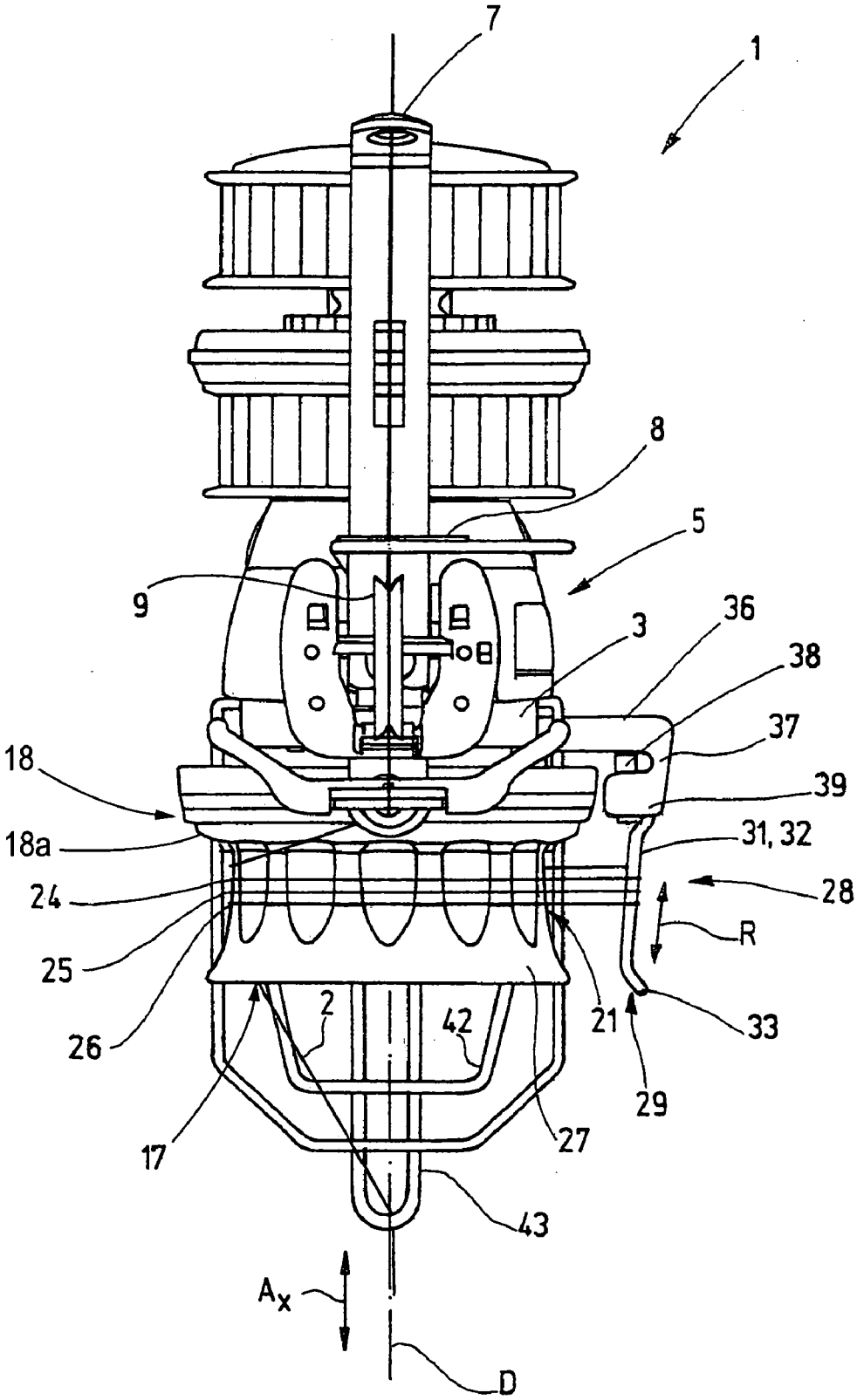
FIG. 3, a front view of the yarn delivery device in FIG. 2.

A yarn lifting element 28 is arranged adjoining the yarn delivery wheel 17, which, in accordance with FIGS. 1, 2 and 3 comprises a U-shaped hoop 29. The hoop is preferably made of wire. The hoop 29 has two legs 31, 32, which are parallel to each other (FIG. 1), and which are connected to each other at their lower free ends by means of a strip 33. The sections of the legs 31, 32 adjoining the storage area are configured straight, and they extend at an acute angle or parallel the axial direction $A_x$ defined by the axis of rotation of the yarn delivery wheel 17. In this way the legs 31, 32 define yarn contact surfaces 34, 25 (FIG. 2), over which each winding 24, 25, 26 of the yarn 2 extends. The yarn contact surfaces 34, 35 are arched (for example cylindrically arched), and each is straight in the longitudinal leg direction R over the entire height of the storage area 21. The lower ends of the legs 31, 32 are placed slightly radially outward, so that the strip 33 is angled away from the yarn delivery wheel 17. The location of the bend lies below the storage area so as to prevent the yarn windings, which rest loosely on the yarn drum, from falling down. The legs 31, 32 are bent or angled outward at their respective upper ends, preferably above the inlet area 18 (FIG. 3). This arrangement entering yarn windings from getting too far toward the top. In this way yarn windings are also prevented from sliding over the upper drum edge and being wound up by the drum shaft. Thus, the upper shoulder of the pins 31, 32 formed by the bend or angle increases the operational dependability.

The hoop 29 can be provided with a ceramic coating, in particular at its contact surfaces 34, 35.

Figure 14:
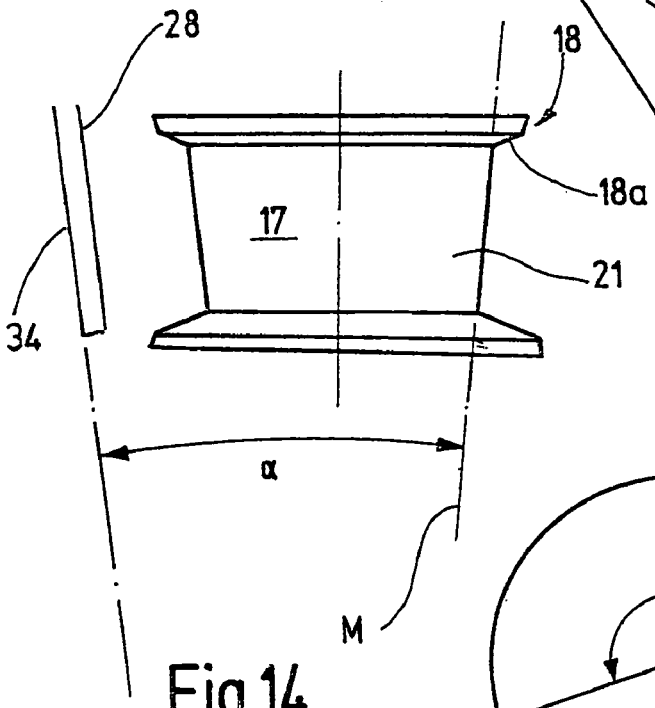

The longitudinal leg direction R matches the axial direction of the yarn delivery wheel 17, or forms an acute angle with it. Because of this, the length of all windings 24, 25, 26 is reduced winding by winding from the inlet side toward the outlet side. As illustrated in FIG. 14, it is important that an acute angle alpha is formed between the yarn contact surface 34 and a generating line M of the storage area located on the opposite side relative to the yarn delivery wheel 17. In place of the open space between the legs 31, 32, a closed surface can also be provided here.

The two upper ends of the legs 31, 32 are maintained on a support 36 (FIGS. 1 and 3), which is pivotally seated on the base body 3 of the yarn delivery device 1, for example around the axis of rotation D extending in the axial direction Ax. The axis of rotation D is vertically arranged. The support 36 has a spring hinge 37 on its outer end, which connects it with the legs 31, 32. The spring hinge 37 maintains the legs 31, 32 in the relaxed state at an acute angle relative to the axis of rotation D. As illustrated in FIG. 3, an adjustment screw 38 is provided in the close vicinity of the spring hinge 37. The adjustment screw 38 is supported on the support 36 and provides the option of setting the pivoted position of the hoop 29 in relation to the support 36.

The adjustment screw is seated in a threaded bore of a base section 39, which is connected via the spring hinge 37 with the support 36, and which furthermore receives the upper ends of the legs 31, 32. Alternatively, the adjustment screw can be seated in a threaded bore of the support 36 and be supported on the base section 39 (FIG. 1). The adjustability of the angle of inclination of the hoop 29 allows an adaptation of the forward yarn feed to varying yarn qualities.

Figure 12:
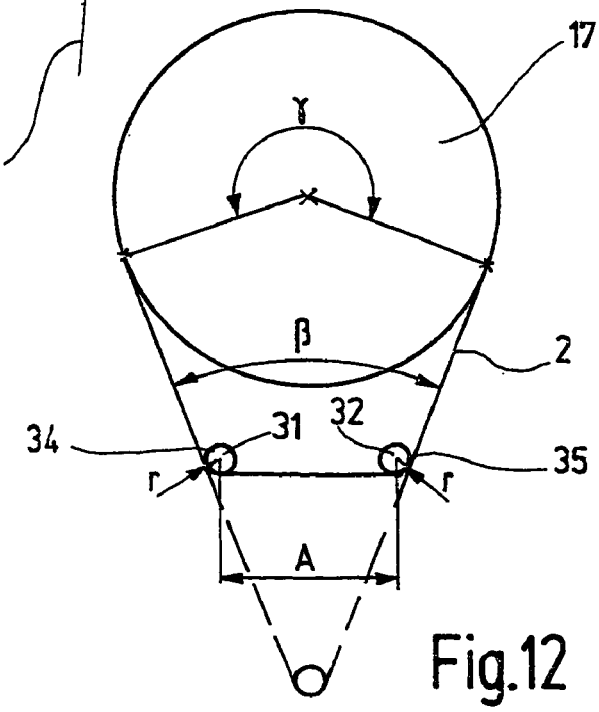

The support 36 is designed in such a way that it maintains the hoop 29, and therefore the legs 31, 32 at a distance of approximately 10 mm to 15 mm from the outer circumference of the storage area 21 of the yarn delivery wheel 17. This arrangement is illustrated in FIG. 12. The pin distance A, i.e. the distance of the yarn contact surfaces 34, 35 from each other (FIG. 12) is preferably approximately 15 mm to 20 mm. This corresponds to a yarn delivery wheel diameter of approximately 45 mm and results in the desired angle of wrap, which is greater than 180°, but less than 240°. In any event, the radius of curvature r of the yarn contact surfaces 34, 35 is less than the distance A.

An outlet yarn guidance arrangement 41 includes a hoop 42, as shown in FIGS. 2 and 3. The hoop 42 is arranged at the side next to the yarn delivery wheel 17 and has a lower horizontal section 43 that guides the yarn 2 and which is maintained laterally below the yarn delivery wheel 17 (FIG. 3). This causes an oblique yarn draw-off. A further hoop 44 and a run-out interrupter 45, which rests on the yarn 2 between the hoops 42 and 43, are provided adjoining the outlet yarn guidance arrangement 41. A run-in interrupter 46, which monitors the yarn running toward the yarn delivery wheel 17, can rest on the yarn between the yarn brake 9 and the inlet yarn guidance arrangement 13.

The yarn guidance arrangement 41, the inlet eye 12, and the axis of rotation D are located on a common level or plane. As a result, the yarn delivery device 1 has no preferred direction of rotation, the yarn delivery wheel 17 can be operated in a clockwise, as well as in a counterclockwise direction.

The yarn delivery device 1 so far described operates as follows:

During operation, the yarn delivery wheel 17 is driven for rotation by a belt that runs over the pulley 14. The yarn 2 is looped around the yarn delivery wheel 17 as shown in FIG. 2. The windings 24, 25, 26 run over the yarn lifting element 28. In this case, the number of revolutions of the yarn delivery wheel 17 is such that the circumferential speed of the yarn delivery wheel is slightly greater than the desired maximum yarn speed. The windings 24, 25, 26 loop around the yarn delivery wheel over a large portion of its circumference, but are raised off the yarn delivery wheel by the yarn lifting element 28. This reduces the frictional action between the yarn 2 and the yarn delivery wheel 17, with the friction still being strong enough so that in the normal case the yarn 2 is delivered with only slight slippage. In this case the yarn has a circumferential speed which is 10% less than the circumferential speed of the delivery wheel 17.

If the yarn consumption station temporarily requires less yarn than is delivered by the yarn delivery device 1, the required yarn speed clearly falls below the circumferential speed of the yarn delivery wheel 17. In such a case, the yarn tension between the yarn delivery wheel 17 and the yarn consumption station is reduced. The lifting device 28 acts in a slightly braking manner on the yarn and prevents the yarn from being conveyed at full speed. The lap built up from the windings 24, 25, 26 is somewhat loosened, so that the conveying speed is reduced to such an extent that the yarn is delivered with slippage and in accordance with the requirements. The reduced frictional action allows the slippage of the windings 24, 25, 26 without a movement or adjustment of the yarn lifting element 28, so that the yarn 2 generally trails the yarn delivery wheel 17. The yarn runs clearly slower than would correspond to the circumferential speed of the yarn delivery wheel 17. This is aided in particular by the ribbed structure of the surface of the storage area 21.

The yarn lifting element 28 is rigidly seated by means of the structure of the displacement mechanism, represented in FIG. 3 and formed by the adjustment screw 38 and the spring hinge 37. The adjustment screw 38 is supported between the yarn delivery wheel 17 and the hoop 29 is supported between the support 36 and the base section 39, while the spring hinge 37 is located radially outward. Therefore, an increased yarn tension cannot cause the hoop 29 to pivot against the yarn delivery wheel 17.

The support 36 is preferably configured to be removable. In such a case, the yarn delivery device can be operated purely as a positive feed wheel unit without slippage effect or, as described above, as a friction feed wheel unit, wherein the knitting station temporarily accepts less yarn in case of a reduced yarn tension. It is also possible to provide the support 36 with a hinge or a joint, for swiveling or pivoting the yarn lifting element 28 into a rest position where the yarn lifting element performs no function. Snap-in or other arresting mechanisms can be provided for maintaining the yarn lifting element either in the working position or the rest position.

It is also possible to employ the yarn delivery device 1 in both ways in that the windings 24, 25, 26 are selectively placed on or not placed on the yarn lifting element 28. Moreover, the yarn lifting element 28 can be designed to be exchangeable, for example by making different hoops 29 available for different yarns. However, it has been found that all tested yarns within a wide spectrum can run over the same hoop 29 if the aforementioned geometric conditions are observed.

Figure 4:
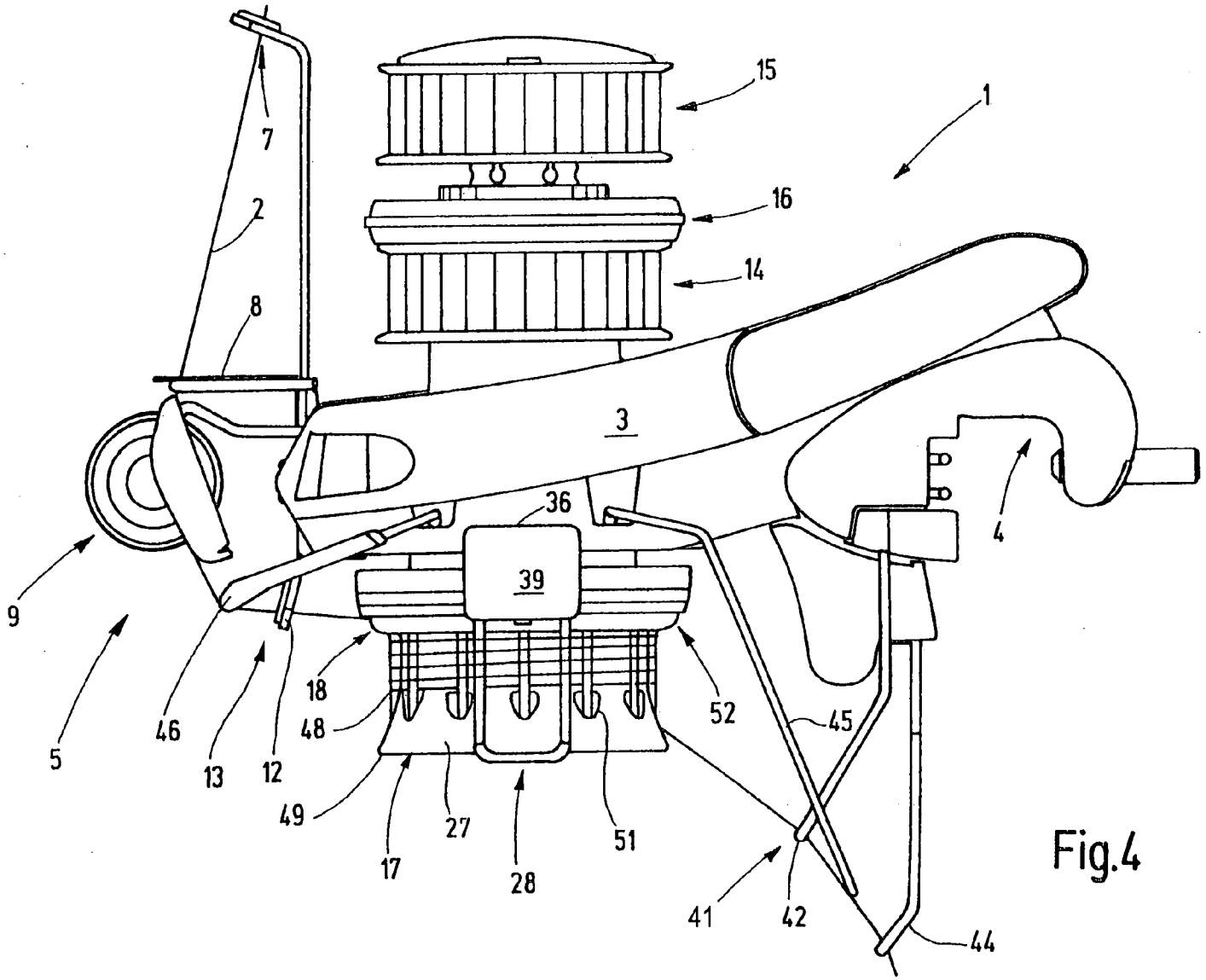
FIG. 4, a lateral view of a modified embodiment of the yarn delivery device, FIG. 5, a lateral view of a further modified embodiment of the yarn delivery device.

A modified embodiment of the yarn delivery device 1 is illustrated in FIG. 4. Except for the yarn delivery wheel 17, the FIG. 4 embodiment has the same elements as the above described yarn delivery device 1 (FIGS. 1 to 3), so that, based on the use of identical reference symbols, reference is made to the above description. In contrast to the above described yarn delivery wheel 17, the yarn delivery wheel 17 in FIG. 4 has the basic structure of a rod cage. The rod cage is formed by a plurality of straight rods 48, which replace the ribs 23 and together form a cylindrical cage, or a very slightly tapering cage. The rods 48 are inserted into an end disk 49, whose tapering outer surface constitutes the yarn run-off edge 27. Openings 51 are formed in the tapering outer surface, into which the rods 48 are inserted. The upper ends of the rods 48 furthermore are maintained in an upper end disk 52, which forms the inlet area 18.

Figure 5:
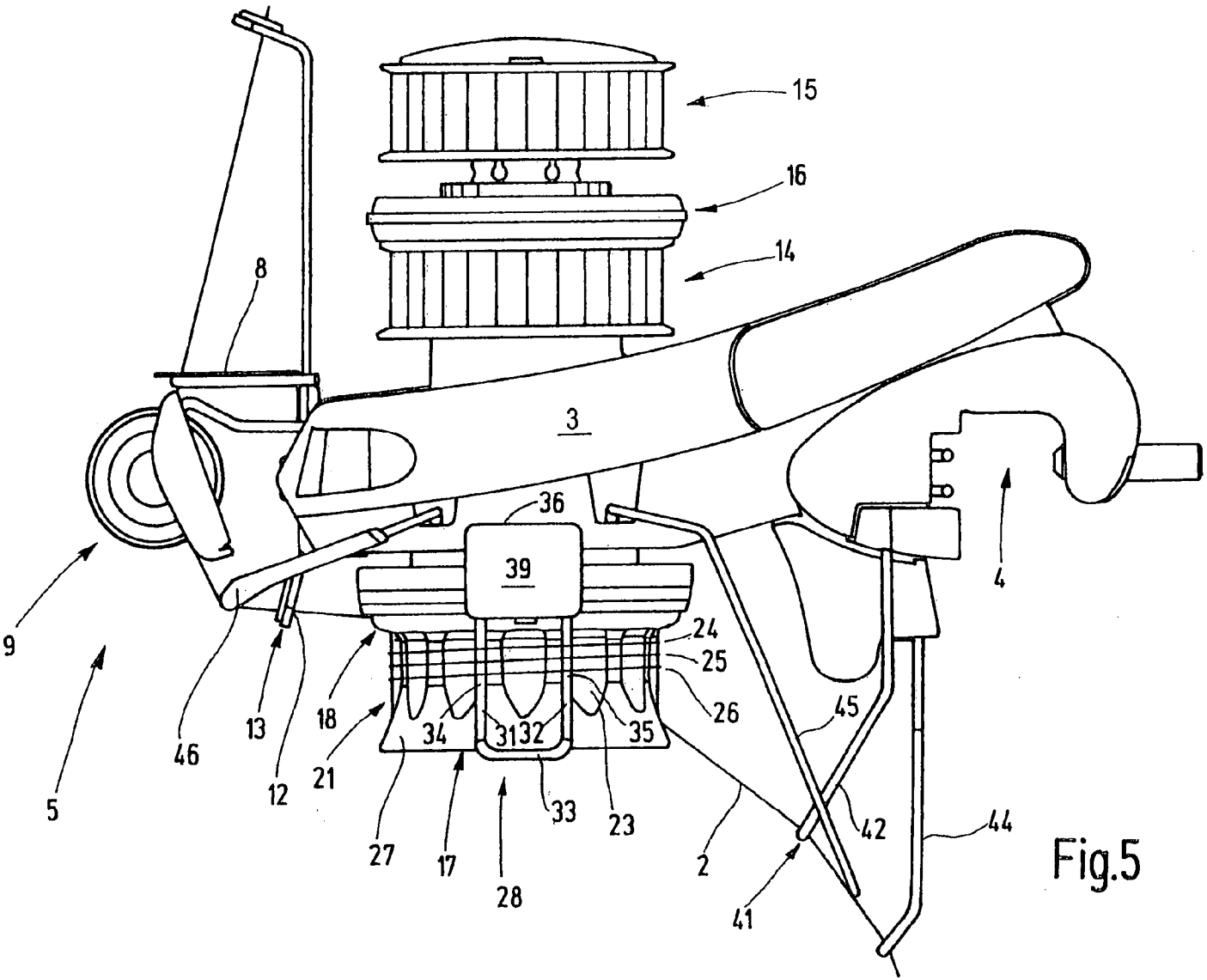

A further embodiment of the yarn delivery device 1 is shown in FIG. 5. The FIG. 5 embodiment mainly corresponds to the embodiment shown in FIGS. 1 to 3 and only differs therefrom in the design of the yarn run-off edge 27 of the yarn delivery wheel 17. The yarn run-off edge 27 is designed as a straight truncated cone, i.e. the radius of the yarn run-off edge 27 increases linearly from top to bottom. Otherwise the description of its structure and function provided in connection with FIGS. 1 to 3 applies and identical reference symbols are used.

Figure 6:
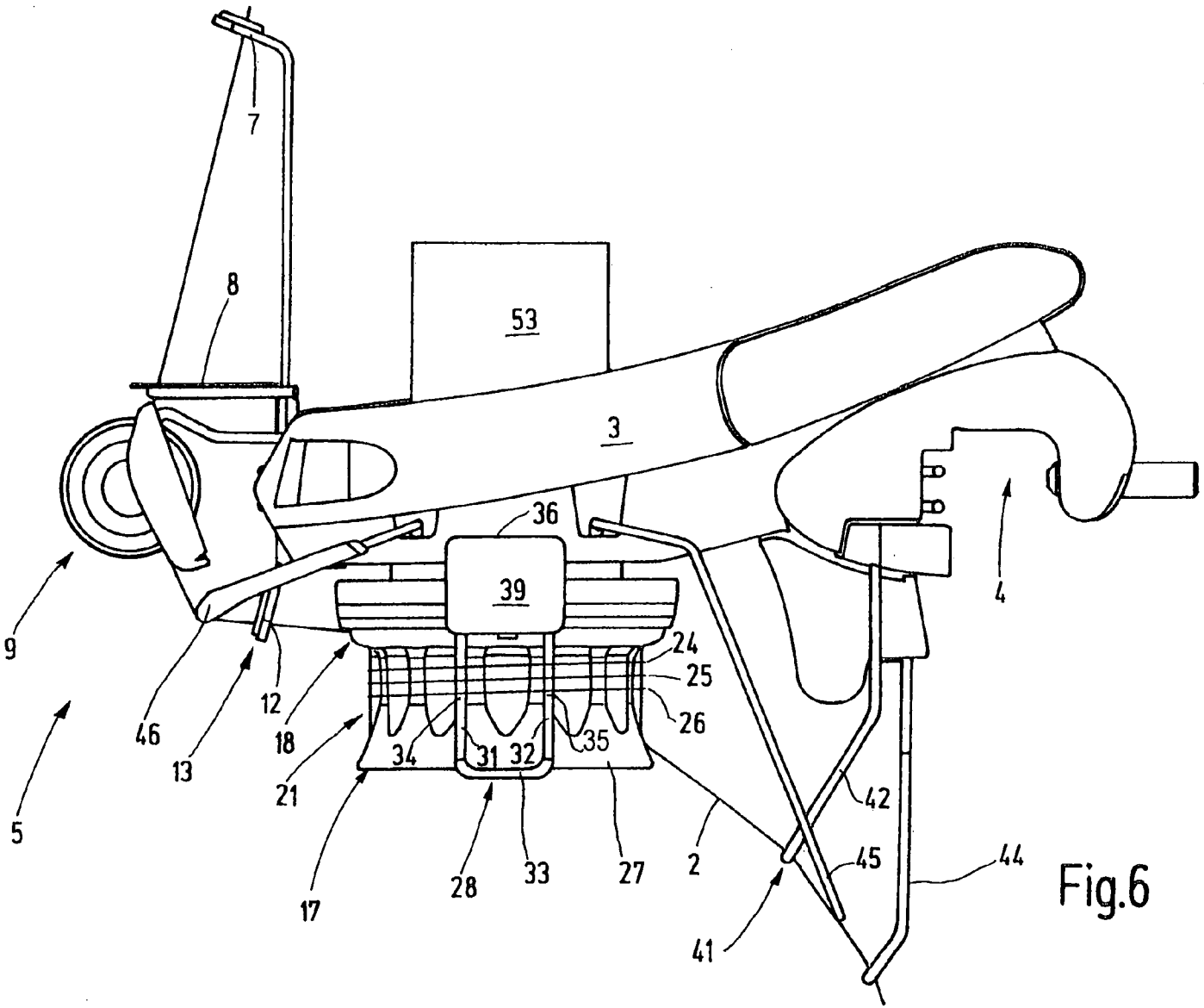
FIG. 6, a lateral view of an embodiment of the yarn delivery device with an electrical drive mechanism, FIG. 7, a lateral view of an embodiment of the yarn delivery device with separate lifting elements, FIG. 8, a front view of a further embodiment of a yarn delivery device with separate lifting elements, FIG. 9, a view from above on a lifting element fastened on a support FIG. 10, a view from above on a modified embodiment of a lifting element, FIG. 11, a view from above on lifting elements maintained on separate supports, FIG. 12, the geometric relationships of the yarn delivery device in accordance with FIG. 1, as well as of an alternative embodiment, FIG. 13, a yarn delivery device with two yarn lifting elements arranged diametrically opposite each other by means of the representation of the geometric relationships, and FIG. 14, the geometric relationships between the yarn delivery wheel and the yarn-lifting device.

FIG. 6 illustrates a further embodiment of the yarn delivery device 1, which is distinguished in that an electric motor is provided for driving the yarn delivery wheel 17. The motor is seated in or projects from the base body 3, as can be seen in FIG. 6. It is also possible to place the electric motor 53 on top of the base body in place of the pulleys 14, 15. The yarn delivery wheel 17 can be designed in accordance with any of the above described versions. In this case, the lifting of the yarn from the yarn delivery wheel 17 enables a slippage of the yarn delivery wheel, without the interrupter reacting, when the yarn delivery and the yarn acceptance do not exactly agree, in particular in case of a minimum acceptance.

Figure 7:
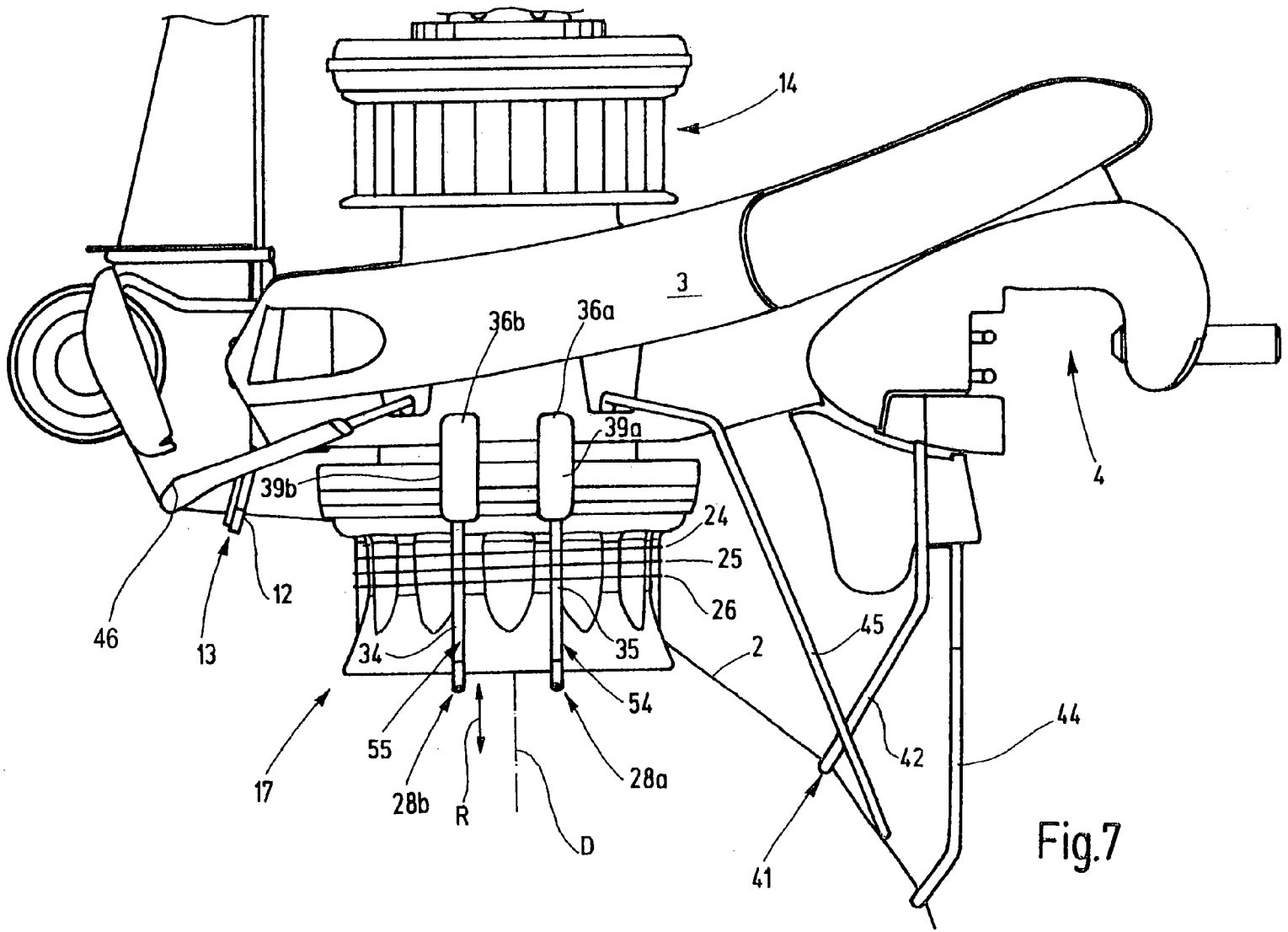
Figure 8:
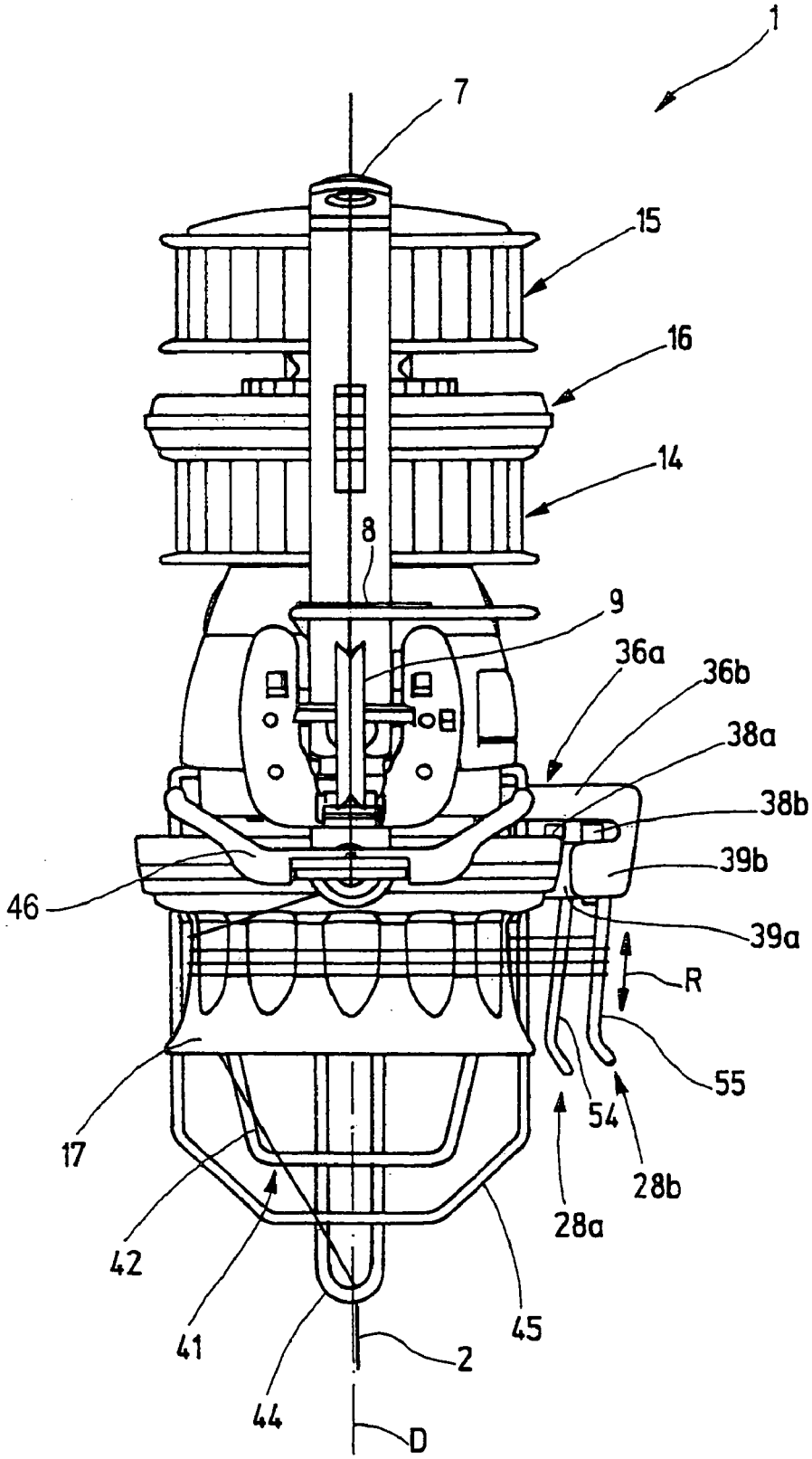

In all of the above described embodiments of the yarn delivery device 1 it is possible to use, instead of one yarn lifting element 28 with two legs 31, 32 fixed relative to each other, the construction shown in FIG. 8 with two yarn lifting elements 28*a*, 28*b*. Both yarn lifting elements are maintained by their own supports 36*a*, 36*b* on their own base section 39*a*, 39*b*. Pins 54, 55, which have a straight configuration, are used as yarn lifting elements and are arranged, the same as the legs 31, 32, substantially parallel with or at an acute angle relative to the axis of rotation D. In this case the pins 54, 55 are aligned parallel with each other and can, if necessary, be adjusted separately by means of their adjustment screws 38*a*, 38*b*. The two supports 36*a*, 36*b* can be pivoted independently of each other, so that the pins 54, 55 can be set to different distances between each other. By means of this the contact angle at which the yarn 2 rests against the yarn delivery wheel 17 can be manually controlled, so that the yarn delivery device 1 can be adapted to installation requirements and/or yarn properties. This can be seen in FIG. 7, for example, which illustrates the two supports 36*a*, 36*b*, which can be pivoted toward or away from each other. FIG. 7 moreover shows the parallel orientation of the pins 54, 55, which is maintained independently of the inclination relative to the axis of rotation D.

Figure 9:
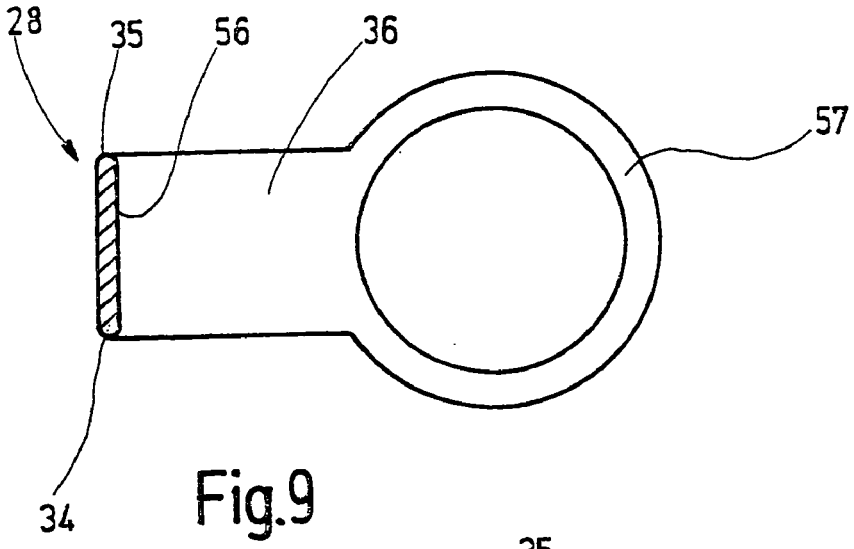

FIG. 9 illustrates a modified embodiment of the yarn lifting element 28. In contrast to the embodiment illustrated in FIGS. 1 to 6, wherein the yarn lifting element 29 a hoop 29, the FIG. 9 yarn lifting element comprises a solid strip 56, which has an elongated cross section with rounded flanks. The rounded flanks define the yarn contact surfaces 34, 35. The strip 56 can be made of, for example a hard alloy, a ceramic material, or another wear-resistant material. The strip can also be bent from sheet metal and provided with a coating of a hard material, for example a ceramic material. The strip can be connected rigidly, or by means of an adjustment device and manually adjustable relative to the support 36, which has a ring-shaped shoulder 57 for fastening on the base support 3.

Figure 10:
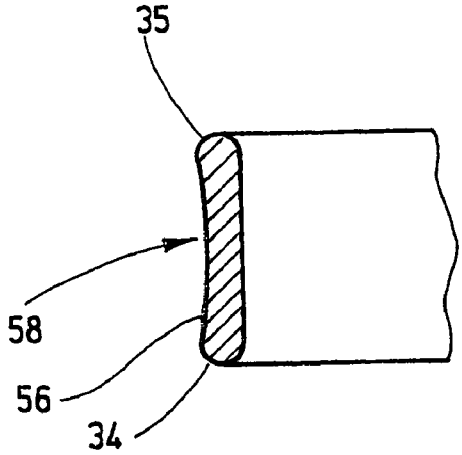

As shown in FIG. 10, the strip 56 can have a groove 58 between its yarn contact surfaces 34, 35, which is spanned by the yarn 2. An operation as described in connection with FIG. 13 can be achieved.

With the embodiments of the yarn lifting element 28 shown in FIG. 9 and FIG. 10, the distance between the yarn contact surfaces 34, 35 preferably lies in the range between 15 mm and 20 mm. In this way the strip 56 operates like and replaces the hoop 29.

Figure 11:
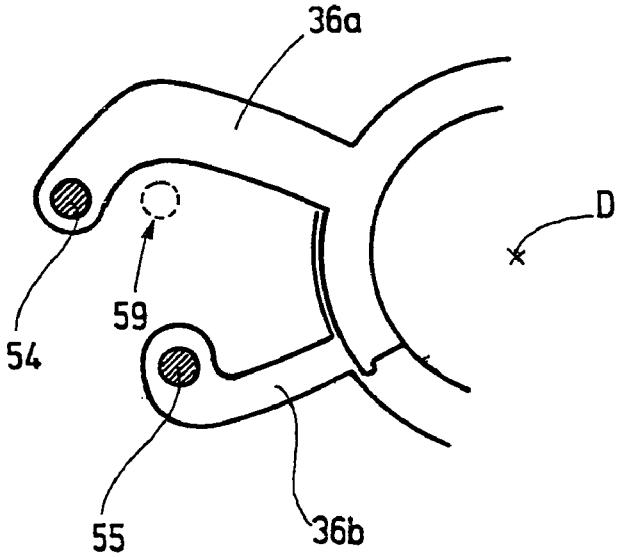

A modification of the embodiment in FIGS. 7 and 8 is also possible and is shown in FIG. 11. The FIG. 7 embodiment is based on both pins 54, 55 being arranged at the same distance from the yarn delivery wheel 17. Therefore the supports 36*a*, 36*b* have the same length. In contrast, the embodiment in FIG. 11 provides supports 36*a*, 36*b* of different lengths, so that the two pins 54, 55 are maintained at different distances from the axis of rotation D and the yarn delivery wheel 17. This opens up the additional possibility of making the pin 55 inactive by pivoting it into the position 59 shown in dashed lines in FIG. 11.

FIG. 12 illustrates an alternative arrangement in dashed lines. The legs 31, 32 have been replaced by a single yarn lifting element 28', which is arranged at a great distance from the yarn delivery wheel 17. This angle is of such a size that the angle beta, which the yarn 2 running toward the leg 31 forms with the yarn 2 running away from the leg 32 remains unchanged.

Figure 13:
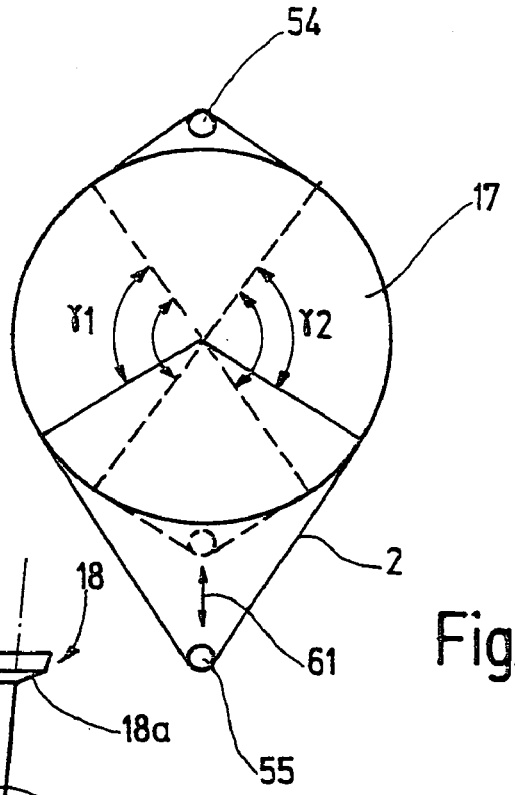

FIG. 13 discloses a further exemplary embodiment of a yarn delivery device with two pins 54, 55. These are arranged with an angular spacing of approximately 180°. The pin 54 is fixed, while the pin 55 can be displaceable in the direction of the arrow 61. With this arrangement, the pin 54 defines a liftoff zone of for example 70°, while the other lifting zone is variable. The loop angle gamma is the sum of both partial loop angles gamma 1 and gamma 2.

A yarn lifting element 28 having straight yarn contact surfaces 34, 35 is provided in a positive feed wheel unit. The position of the surfaces cannot be displaced by the yarn 2 enabling the yarn to slip relative to the yarn delivery wheel 17 if necessary. This permits the positive feed wheel unit to be used in applications which had previously been excluded because of the required synchronicity between the yarn delivery and yarn consumption.

LIST OF REFERENCE SYMBOLS

1 Yarn delivery device
2 Yarn
3 Base body
4 Clamp
5 Yarn inlet means
7 Inlet eye
8 Knot catcher
9 Yarn brake
11 Support
12 Inlet eye
13 Inlet yarn guidance arrangement
14, 15 Pulleys
16 Coupling ring
17 Yarn delivery wheel
18 Inlet area
18*a*, 18*b* Sections
19 Yarn protection sleeve
21 Yarn conveying area
22 Cylindrical section
23 Ribs
24, 25, 26 Windings
27 Yarn run-off edge
28 Yarn lifting element
29 Hoop
31, 32 Legs
33 Strip
34, 35 Yarn contact surfaces
36 Support
37 Spring hinge
38 Adjustment screw
39 Base section
41 Outlet yarn guidance arrangement
42 Hoop
43 Strip
44 Hoop
45 Run-out interrupter
46 run-in interrupter
48 Rod
49 End disk
51 Openings
52 End disk
53 Motor
54, 55 Pins
56 Strip
57 Shoulder
58 Groove
59 Position

What is claimed is:

1. A yarn delivery device for delivering yarn to a yarn consumption arrangement having variable yarn requirements comprising:

a yarn delivery wheel having a storage area with a yarn bearing area for receiving a wound yarn lap and an inlet area with a forward feed arrangement for forward feeding of the wound lap;

a drive shaft upon which said yarn delivery wheel is mounted, a drive mechanism connected to said drive shaft for driving said delivery wheel such that an outer circumferential surface of said delivery wheel has a predetermined circumferential speed, a yarn lifting element mounted in spaced apart relation to the outer circumferential surface of said delivery wheel, said yarn lifting element having a pair of straight yarn contact and guide surfaces disposed in outwardly spaced relation to the outer circumferential surface of the delivery wheel and extending substantially parallel to an axis of said yarn delivery wheel, said yarn contact and guide surfaces being laterally spaced apart in a direction perpendicular to the axis of said delivery wheel such that yarn can encircle and freely travel about the delivery wheel and said laterally spaced contact and guide surfaces of said yarn lifting element in a lap comprising a plurality of windings with the contact and guide surfaces allowing only a portion of the windings corresponding to an arc less than 240° the circumference of the yarn delivery wheel to contact the yarn bearing area of the yarn delivery wheel with said windings being free to move along the lengths of said straight contact and guide surfaces such that the yarn delivery wheel may be driven by said drive mechanism at a greater circumferential speed than the speed of movement of the windings about the delivery wheel and yarn lifting element and when the yarn requirement of the yarn consumption arrangement is reduced a resulting lowering in tension of the yarn lap about the yarn delivery wheel and yarn lifting element as an incident to the reduced yarn consumption requirement permits a reduction in frictional contact of the yarn with the yarn delivery wheel and a reduction in the speed of movement of the yarn about the delivery wheel relative to the predetermined circumferential speed of the delivery wheel and a slowing of the yarn delivery speed to the yarn consumption arrangement.

2. The yarn delivery device in accordance with claim 1, wherein the forward feed arrangement comprises a ring-shaped guide surface that tapers in the axial and makes a continuous transition into the storage area of the yarn delivery wheel.

3. The yarn delivery device in accordance with claim 1, wherein the yarn delivery wheel is a rod cage including a plurality of rods, the rods of the rod cage defining the storage area and the inlet area of the yarn delivery wheel.

4. The yarn delivery device in accordance with claim 1, wherein the yarn delivery wheel comprises a one-piece drum with a profile formed by ribs in the storage area of the yarn delivery wheel.

5. The yarn delivery device in accordance with claim 1, wherein the diameter of the storage area of the yarn delivery wheel is reduced in a running direction of the yarn.

6. The yarn delivery device in accordance with claim 1, wherein an inlet yarn guidance arrangement is provided upstream of the yarn delivery wheel for the yarn running to the yarn delivery wheel, the inlet yarn guidance arrangement being fixed in place, and wherein an outlet yarn guidance arrangement is provided downstream of the yarn delivery wheel for the yarn moving away from the yarn delivery wheel.

7. The yarn delivery device in accordance with claim 6, wherein the inlet yarn guidance arrangement, the outlet yarn guidance arrangement and the yarn delivery wheel are arranged on a common level and the inlet yarn guidance arrangement is arranged above the storage area of the yarn delivery wheel, the outlet yarn guidance arrangement is rigidly seated and the outlet yarn guidance arrangement is arranged below the storage area of the yarn delivery wheel.

8. The yarn delivery device in accordance with claim 1, wherein the yarn lifting element is supported so as to be manually adjustable.

9. The yarn delivery device in accordance with claim 1, wherein the yarn lifting element axially projects above the storage area of the yarn delivery wheel at the inlet area and on a yarn run-off edge of the yarn delivery wheel.

10. The yarn delivery device in accordance with claim 1, wherein the yarn lifting element is releasably supported on the yarn delivery device.

11. The yarn delivery device in accordance with claim 1 in which said yarn lifting element is disposed a distance of between 15 and 20 mm from the outer circumferential surface of the yarn delivery wheel.

12. The yarn delivery device in accordance with claim 1 in which said yarn delivery wheel and yarn lifting element are operative for directing yarn about said delivery wheel at a speed which is about 10% less than the circumferential speed of the delivery wheel.

13. The yarn delivery device of claim 1 in which said yarn lifting element is a U-shaped member with said contact and guide surfaces being defined by opposite legs of the u-shaped member.

14. The yarn delivery device of claim 1 in which said yarn lifting device comprises a pair of elongated pins.

15. The yarn delivery device of claim 1 including a support disposed in fixed relation to said yarn delivery device for supporting said yarn lifting element in depending relation to an upper side of said yarn delivery wheel.

16. The yarn delivery device of claim 1 in which said yarn contact and guide surfaces have curved sides for guiding yarn in circling relation about said delivery wheel and the yarn lifting element.

17. The yarn delivery device of claim 1 in which said yarn contact and guide surfaces are laterally spaced a distance corresponding to at least one third the diameter of the delivery wheel.

18. A yarn delivery device for delivering yarn to a yarn consumption arrangement having variable yarn requirements comprising:

a yarn delivery wheel having a storage area with a yarn bearing area circumferentially about the yarn delivery wheel for receiving a wound yarn lap and an inlet area with a forward feed arrangement for forward feeding of the wound lap;

a drive shaft upon which said yard delivery wheel is mounted, a drive mechanism connected to said drive shaft for driving said delivery wheel such that an outer circumferential surface of said delivery wheel has a predetermined circumferential speed, a yarn inlet guide for guiding yarn onto one side of said rotating yarn delivery wheel, a yarn lifting element mounted in spaced apart relation to the outer circumferential surface of said delivery wheel adjacent a side of said yarn delivery wheel opposite the side said yarn is guided onto the yarn delivery wheel by said yarn inlet guide, said yarn lifting element having a pair of straight yarn contact and guide surfaces disposed in outwardly spaced relation to the outer circumferential surface of the delivery wheel and extending substantially parallel to an axis of said yarn delivery wheel, said yarn contact and guide surfaces being laterally spaced apart in a direction perpendicular to the axis of said delivery wheel such that yarn can encircle and freely travel about the delivery wheel and said laterally spaced contact and guide surfaces of said yarn lifting element in a lap comprising a plurality of windings with the contact and guide surfaces allowing only a portion of the windings corresponding to an arc less than 240° the circumference of the yarn delivery wheel to contact the yarn bearing area of the yarn delivery wheel with said windings being free to move along the lengths of said straight contact and guide surfaces such that the yarn delivery wheel may be driven by said drive mechanism at a greater circumferential speed than the speed of movement of the windings about the delivery wheel and yarn lifting element and when the yarn requirement of the yarn consumption arrangement is reduced a resulting lowering in tension of the yarn lap about the yarn delivery wheel and yarn lifting element as an incident to the reduced yarn consumption requirement permits a reduction in frictional contact of the yarn with the yarn delivery wheel and a reduction in the speed of movement of the yarn about the delivery wheel relative to the predetermined circumferential speed of the delivery wheel and a slowing of the yarn delivery speed to the yarn consumption arrangement.

19. The yarn delivery device of claim 18 including a yarn outlet guide downstream of the yarn delivery wheel for guiding yarn away from the yarn delivery wheel from a common side as yarn is guided onto by yarn inlet guide.

20. The yarn delivery device of claim 18 including a support disposed in fixed relation to said yarn delivery device for supporting said yarn lifting element in depending relation to an upper side of said yarn delivery wheel.

* * * * *